US006609395B2

(12) United States Patent
Ando

(10) Patent No.: US 6,609,395 B2
(45) Date of Patent: Aug. 26, 2003

(54) DOUBLE-CYLINDER CIRCULAR STOCKING KNITTING MACHINE WITH STRUCTURALLY HIGHLY SIMPLIFIED CAM BOX

(75) Inventor: Jan Ando, Scandicci (IT)

(73) Assignee: Matec S.p.A., Scandicci (IT)

( * ) Notice: Subject to any disclaimer, the term of this patent is extended or adjusted under 35 U.S.C. 154(b) by 66 days.

(21) Appl. No.: 10/332,196

(22) PCT Filed: Nov. 20, 2001

(86) PCT No.: PCT/EP01/13429

§ 371 (c)(1),
(2), (4) Date: Jan. 7, 2003

(87) PCT Pub. No.: WO02/42536

PCT Pub. Date: May 30, 2002

(65) Prior Publication Data

US 2003/0101775 A1 Jun. 5, 2003

(30) Foreign Application Priority Data

Nov. 22, 2000 (IT) ..... MI00A2515

(51) Int. Cl.[7] ..... B04B 15/32
(52) U.S. Cl. ..... 66/57
(58) Field of Search ..... 66/18, 20, 215, 66/216, 222, 223, 218, 219, 220, 221, 57, 224, 225, 226, 227

(56) References Cited

U.S. PATENT DOCUMENTS

| | | | | |
|---|---|---|---|---|
| 3,930,383 A | | 1/1976 | Nuber | |
| 4,541,253 A | * | 9/1985 | Luchi et al. | 66/14 |
| 6,257,026 B1 | * | 7/2001 | Ando' et al. | 66/221 |

FOREIGN PATENT DOCUMENTS

| | | |
|---|---|---|
| EP | A-0 074 931 | 3/1983 |
| GB | A-2 264 721 | 9/1993 |
| WO | A-00 71795 | 11/2000 |

* cited by examiner

*Primary Examiner*—Danny Worrell
(74) *Attorney, Agent, or Firm*—Welsh & Katz, Ltd.

(57) ABSTRACT

In a double-cylinder circular stocking knitting machine, an actuation element, composed of a slider and a sub-slider, is arranged, at least in the lower needle cylinder, below each needle, inside the same axial slot of the curved surface of the lower needle cylinder. The sub-slider has an actuation element provided with two heels which oscillates to assume a first, a second, or a third position, in which the heels assume different positions. A cam box is arranged around the curved surface of the needle cylinders and comprises a plurality of cams, which define paths for actuation of the sub-slider and of the overlying slider.

6 Claims, 1 Drawing Sheet

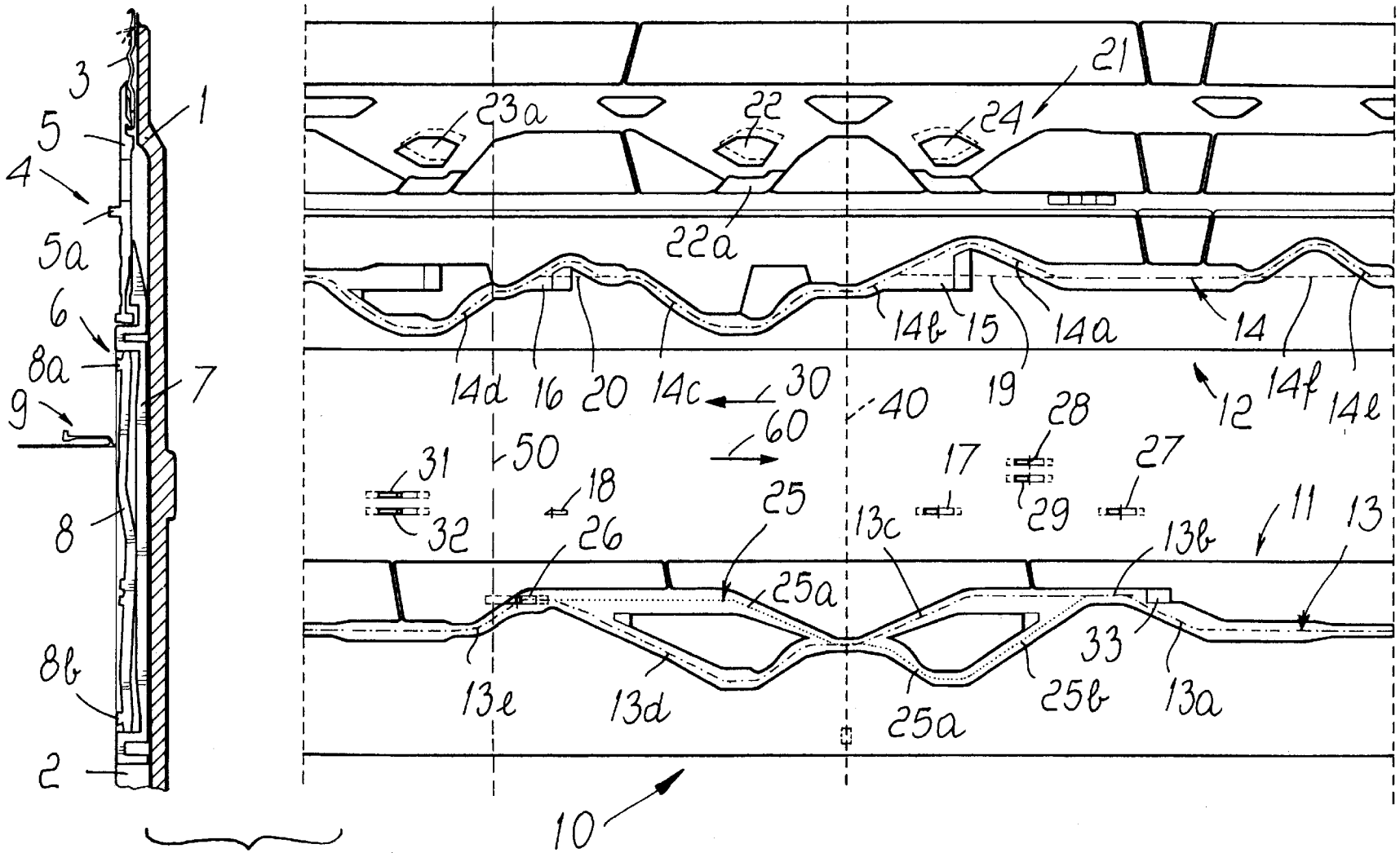
1
2
3
4
5
5a
6
7
8
8a
8b
9
10
11
12
13
13a
13b
13c
13d
13e
14
14a
14b
14c
14d
14e
14f
15
16
17
18
19
20
21
22
22a
23a
24
25
25a
25b
26
27
28
29
30
31
32
33
40
50
60

DOUBLE-CYLINDER CIRCULAR STOCKING KNITTING MACHINE WITH STRUCTURALLY HIGHLY SIMPLIFIED CAM BOX

BACKGROUND OF THE INVENTION

The present invention relates to a double-cylinder circular stocking knitting machine with structurally highly simplified cam box.

It is known that double-cylinder stocking knitting machines comprise a lower needle cylinder and an upper needle cylinder, which is arranged upward and coaxially with respect to the lower needle cylinder. In the curved surface of the two needle cylinders there are multiple slots that run parallel to the axis of the cylinders. Inside each one of said slots there is a double- or twin-hook needle, typical of double-cylinder machines. In each slot of the upper needle cylinder there is an upper slider, which can engage the upper hook of the needle arranged in said slot in order to actuate it when it has to knit in the upper needle cylinder, i.e., during the formation of purl stitches.

In each slot of the lower needle cylinder there is a lower slider, which can engage the lower hook of the needle arranged in the same slot in order to actuate it when it has to knit in the lower needle cylinder, i.e., during the formation of plain stitches.

Below the lower slider, inside the same slot, there is a sub-slider, which acts as a memory, and there is a selector, which is used to select the needles that must knit at a given feed or drop and to actuate in a different manner the needles that are moved to knit in order to perform the various knitting processes.

The upper slider and the lower slider are each provided with two heels, which are mutually spaced parallel to the longitudinal extension of the slider, i.e., parallel to the axis of the needle cylinder, and protrude constantly, in a radial direction, from the corresponding slot of the needle cylinders.

The sub-slider also is provided with a heel, which protrudes constantly and radially from the corresponding slot of the needle cylinders.

The selector is generally of the oscillating or elastic type and is provided with main heels, an upper one and a lower one, and with one or more secondary selection heels that are arranged between said two main heels. The upper main heel protrudes constantly, in a radial direction, from the slot of the lower needle cylinder, while the lower main heel can move from an active position, in which it protrudes from the slot, to an inactive position, in which it is fully contained within the slot. The secondary selection heels also protrude from the slot when the selector is in the active position.

The cam box is arranged around the needle cylinders and supports a plurality of cams, which form paths that can be engaged by the heels of the sliders, sub-sliders and selectors so as to cause the intended actuation of the needles when the needle cylinders are actuated rotationally about their axis with respect to the cam box.

In currently commercially available double-cylinder machines, in order to perform the various knitting processes, i.e., in order to vary the paths defined by the cams, many of the cams that actuate the sliders are provided so that they are movable and can be shifted on command toward or away from the needle cylinders, respectively in order to engage or not engage the heels of the sliders.

The presence of the movable cams is a problem, since such cams increase the structural complexity of the cam box and require the use of actuators which, in addition to having to be actuated, must also be controlled in order to avoid accidental interferences between the heels and the cams.

Besides the need to have movable cams, the cam box of known types of double-cylinder machine is extremely complicated and challenging during design, assembly and fine-tuning of the machine.

SUMMARY OF THE INVENTION

The aim of the present invention is to solve the above noted problems, by providing a double-cylinder circular stocking knitting machine which, while being able to perform the knitting processes of currently commercially available double-cylinder machines, has a cam box that is structurally simpler.

Within this aim, an object of the invention is to provide a machine in which the use of cams that can move toward and away from the needle cylinders is reduced considerably or even eliminated.

Another object of the invention is to provide a machine that also allows to increase the number and type of processes that can be performed at a same feed or drop of the machine.

This aim and these and other objects that will become better apparent hereinafter are achieved by a double-cylinder circular stocking knitting machine, comprising lower and upper needle cylinders arranged above and coaxially with respect to said lower needle cylinder; multiple slots being formed in the curved surface of said needle cylinders and running parallel to the axis of said needle cylinders; each one of said slots accommodating a twin-hook needle, a lower actuation element arranged in the lower needle cylinder, and an upper actuation element arranged in the upper needle cylinder; each one of said actuation elements being provided with at least one heel suitable to protrude radially from the corresponding slot of the needle cylinder and being actuatable so as to actuate the overlying or underlying needle; a cam box being arranged around the curved surface of said needle cylinders, said cam box having a plurality of cams that form paths that can be engaged by said at least one heel; said needle cylinders being rotationally actuatable about their own axis with respect to said cam box; characterized in that at least said lower actuation element comprises a slider that can detachably engage the lower hook of the overlying needle and, below it, a sub-slider provided with an actuation element that has two heels, an upper one and a lower one, which are mutually spaced along an extension of, and parallel to the axis of the needle cylinders; said actuation element being able to oscillate on a plane that passes through the axis of the needle cylinders in order to assume a first position, in which said lower heel is fully contained within the corresponding slot and the upper heel is extracted from the corresponding slot, or a second position, in which said lower heel is extracted from the corresponding slot and said upper heel is fully contained within the corresponding slot, or a third position, in which said lower heel and said upper heel are both fully contained within the corresponding slot; actuation means being provided which act on said actuation element for its transfer into one of said positions; said plurality of cams of the cam box comprising a first set of cams, which define paths for said lower heel for the actuation of said sub-slider and of the overlying slider in the transfer of the corresponding needle from the lower to the upper needle cylinder and in knitting processes with an alternating motion of the cylinders about their axis, and a second set of cams, which define paths for said upper heel for the actuation of said sub-slider and of the overlying slider in the actuation of the corresponding needle in the formation of drop stitches, in the formation of tuck stitches, and in the transfer of the needle from the upper to the lower needle cylinder.

BRIEF DESCRIPTION OF THE DRAWINGS

Further characteristics and advantages of the invention will become better apparent from the description of a preferred but not exclusive embodiment of the machine according to the invention, illustrated only by way of non-limitative example in the accompanying drawings, wherein:

the only FIGURE is a flat projection view of the portion of the cam box related to the lower needle cylinder of the machine according to the invention, showing laterally a needle, a slider and a sub-slider arranged in a same slot of the lower needle cylinder.

DESCRIPTION OF THE PREFERRED EMBODIMENTS

For the sake of simplicity of description, the machine according to the invention is described hereinafter, with reference to the only FIGURE, exclusively as regards the portion of the cam box and of the elements required for the actuation of the needles of the lower needle cylinder.

As regards the upper needle cylinder, it is possible to use sliders of the conventional type with an upper cam box portion of the conventional type or sliders and sub-sliders that are similar to the ones described with reference to the lower needle cylinder with a cam box portion that is conceptually similar to the lower portion, of course in an inverted position with respect to the elements of the machine related to the lower needle cylinder.

The machine according to the invention comprises, in a per se known manner, a lower needle cylinder 1 and an upper needle cylinder, which is arranged above and coaxially with respect to the lower needle cylinder 1. In the curved surface of the two needle cylinders there are multiple slots 2 that run parallel to the axis of the needle cylinders. Each slot 2 of the lower needle cylinder 1 is aligned with a slot of the upper needle cylinder.

Inside each slot 2 of the upper needle cylinder and of the lower needle cylinder 1 there is a double- or twin-hook needle 3, of the type usually used in double-cylinder machines, which can pass, by controlled sliding, from the lower needle cylinder 1 to the upper needle cylinder or vice versa, according to the requirements of the process.

Below the needle 3, inside the corresponding slot 2 of the curved surface of the lower needle cylinder 1, there is a lower actuation element 4, which is provided with at least one heel that is suitable to protrude radially from the corresponding slot and can be actuated in order to actuate the overlying needle 3.

Around the curved surface of the lower needle cylinder 1 there is a cam box 10, which comprises a plurality of cams that define paths that can be engaged by the heel or heels of the lower actuation elements 4.

Said paths are shaped so as to obtain, as a consequence of the rotation of the needle cylinders about their own axis with respect to the cam box 10, the intended actuation of the needles 3 on the part of the corresponding actuation element 4 in order to perform the required processes, as will become apparent hereinafter.

The lower actuation element 4 comprises a lower slider 5 and, below it, a sub-slider 6.

The slider 5, proximate to its upper end, can be shaped substantially like sliders of the known type, so as to be able to engage and disengage the lower hook of the overlying needle 3.

The slider 5, in an intermediate region of its longitudinal extension, is provided with a heel 5*a* that protrudes radially from the slot 2.

The sub-slider 6 comprises a connecting element 7, which engages, proximate to its upper end, the lower end of the slider 5 and is provided with an actuation element 8.

Said actuation element 8 is provided with two heels, respectively an upper heel 8*a* and a lower heel 8*b*, which are mutually spaced along the longitudinal extension of the actuation element 8, i.e., parallel to the axis of the needle cylinders.

The actuation element 8 can oscillate on a plane that passes through the axis of the needle cylinders in order to assume a first position, in which its lower heel 8*b* is fully contained in the corresponding slot 2 and its upper heel 8*a* is extracted from the slot 2, or a second position, in which its lower heel 8*b* is extracted from the corresponding slot 2 and its upper heel 8*a* is fully contained in the slot 2, or a third position, in which its upper heel 8*a* and its lower heel 8*b* are both fully contained in the corresponding slot 2.

The lower actuation element 4 can be of the type disclosed in WO 00/71795 A1 by the same Applicant.

The machine further comprises selection devices 9, for example of the type disclosed in Italian patent application no. MI99A-000932 by the same Applicant, which act individually on the various actuation elements 8 in order to cause their oscillation so as to achieve their transfer to the second position or third position, as will become apparent hereinafter.

The plurality of cams of the cam box 10 comprises: a first set of cams 11, which define paths for the lower heel 8*b* of the actuation element 8 in order to actuate the sub-slider 6 and accordingly actuate the corresponding slider 5 in the transfer of the needle 3 from the lower needle cylinder 1 to the upper needle cylinder and in processes entailing an alternating motion of the cylinders about their own axis, and a second set of cams 22, which define paths for the upper heel 8*a* of the actuation element 8 in order to actuate the sub-slider 6 and the overlying slider 5 in the actuation of the corresponding needle 3 in forming drop stitches, in forming tuck stitches and in transferring the needle 3 from the upper needle cylinder to the lower needle cylinder 1.

Furthermore, the first set of cams 11 defines a path for the lower heel 8*b* of the actuation element 8 in order to actuate the sub-slider 6 and the overlying slider 5 when the corresponding needle 3 is located in the upper needle cylinder.

More particularly, the first set of cams 11 defines a primary path 13, which is followed by the lower heel 8*b* when the actuation element 8 is in the second position of the continuous rotary motion of the needle cylinders about their own axis in the direction indicated by the arrow 30 with respect to the cam box.

This primary path 13, indicated by a dot-and-dash line, has: a first rising portion 13*a*, which is used to transfer the corresponding needle 3 from the lower needle cylinder 1 to the upper needle cylinder; a first holding portion 13*b*, ahead of a first feed or drop of the machine, whose position is indicated schematically by the line 40, which is meant to keep the slider 5 raised in order to protect the tab or tongue of the lower hook of the needle 3 transferred in the upper needle cylinder; a descending portion 13*c*, in order to allow the closure of the tab of the needle 3 transferred into the upper needle cylinder; a second rising portion 13*d* ahead of a second feed or drop of the machine, whose position is shown schematically by the line 50, which is meant to cause the lifting of the slider 5 until it opens (and protects) the tab of the lower hook of the needle 3 transferred into the upper needle cylinder; and a further descending portion 13*e*, in order to allow the closure of the tab of the needle 3 transferred into the upper needle cylinder.

When one wishes to transfer a needle 3 from the lower needle cylinder 1 to the upper needle cylinder, one acts by means of the selection devices 9 on the actuation element 8 located below said needle 3, so as to make it pass into the second position, in which its lower heel 8*b* protrudes from the slot 2 and thus engages the first rising portion 13*a*, by virtue of which the needle 3 is made to pass from the lower needle cylinder 1 to the upper needle cylinder.

If one does not intervene to modify the position of the actuation element 8, said actuation element continues to move along the rising portions 13*a*, 13*d* and the descending portions 13*c*, 13*e*, causing the overlying slider 5 to rise, in order to open and/or protect the tab of the transferred needle, ahead of a feed or drop, and then descend.

This primary path 13 therefore performs the so-called memory function in repeating the actuation of the lower sliders 5 whose needle 3 is located in the upper needle cylinder.

When the transfer of the needle 3 from the lower needle cylinder 1 to the upper needle cylinder is not required, ahead of the rising portion 13*a* along the direction 30 the actuation element 8 is moved or held in the first position, which corresponds to use of the needle 3 in the lower needle cylinder 1, or in the third position, which corresponds to non-use of the needle 3, which however remains in the lower needle cylinder 1.

The second set of cams 12 defines a path 14, shown by a dot-and-dash line, which is engaged by the upper heel 8*a* of the actuation element 8 when it is in the first position.

Said path 14 has a first rising portion 14*a*, ahead of the feed 40 along the direction 30, which is meant to raise the needle 3, in the lower needle cylinder 1, to the so-called "drop stitch" level, i.e., to a level at which the loop of knitting formed by the upper hook of the needle 3 moves below and beyond its open tab so as to form drop stitches at the feed or drop 40.

Directly before and after the feed 40, the path 14 has a first descending portion 14*b* to allow the descent of the slider 5 and therefore of the corresponding needle 3 after engaging the thread or threads dispensed at the feed 40 in order to form new loops of knitting.

After the second feed 50, the path 14 has a second rising portion 14*c* that is followed, directly before and after the feed 50, by a second descending portion 14*d* whose functions are similar to those of the rising portion 14*a* and descending portion 14*b*.

If one wishes to form tuck stitches at the feed 40, directly before the rising portion 14*a*, the actuation element 8 is moved, by virtue of the selection devices 9, into the third position, so as to not raise the needle 3 to a level that drops the previously formed loop. After moving beyond the rising portion 14*a*, along which the upper heel 8*a* has not traveled, the actuation element 8 is returned to the first position.

In order to allow the actuation element to reach the first position, in the second cam set 12, after the first rising element 14*a*, there is a recess 15 that allows the heel 8*a* to be extracted again from the slot 2 in order to engage the subsequent descending portion 14*b*.

Likewise, when one wishes to form tuck stitches at the feed 50, directly before the second rising portion 14*c*, the actuation element 8 is moved, by virtue of selection devices, into the third position and, after moving beyond the rising portion 14*c* along which the upper heel 8*a* does not travel, it is returned to the first position.

In this case also, in the second cam set 12, after the second rising portion 14*c*, there is a recess 16 that allows the heel 8*a* to be extracted again from the slot 2 in order to engage the subsequent descending portion 14*d*.

The transfer of the actuation element 8 from the third position to the first position can be achieved by virtue of presser elements 17 and 18, which are arranged in the cam box 10 and can move on command toward or away from the lower needle cylinder 1 in order to interfere or not with the actuation element 8.

The paths followed by the upper heel 8*a* when the actuation element 8 is moved into the third position so as to not engage the rising portions 14*a* and 14*c* are indicated by a dashed line and are designated by the reference numerals 19 and 20.

In a region located ahead of the rising portion 13*a* of the first cam set 11 along the direction 30, the path 14, defined by the second cam set 12, has an additional rising portion 14*e*, which lifts the slider 5 until it engages the lower hook of the needle 3 when it is in the upper needle cylinder in order to transfer the needle 3 from the upper needle cylinder to the lower needle cylinder 1.

If one does not wish to transfer the needle 3 from the upper needle cylinder to the lower needle cylinder, the actuation element 8 is moved, directly ahead of the rising portion 14*e*, along the direction 30, into the third position by virtue of the selection devices 9. In this case, the upper heel 8*a* does not engage the rising portion 14*e* and moves along the path 14*f* shown in dashed lines.

After the portion 14*f*, the actuation element can be returned to the first position by virtue of a presser 27, which can move on command toward or away from the needle cylinders.

The cam box 10 further comprises a third set of cams 21, which form paths for the heel 5*a* of the sliders 5, in particular for actuating the sliders 5 that are to actuate the needles 3 that are active in the lower needle cylinder 1. This third set of cams comprises, proximate to the first feed 40, a first lowering cam 22 with a corresponding complementary cam 22*a* and, proximate to the second feed 50, a second lowering cam 23 with a corresponding complementary cam 23*a*.

Proximate to the first feed 40, in a position that is substantially symmetrical to the lowering cam 22 with respect to the position line of the first feed 40, there is a third lowering cam 24 with a corresponding complementary cam 24*a*, which is used in the reverse motion, indicated by the arrow 60, of the needle cylinders about their own axis, when they are actuated with an alternating rotary motion, for example during the formation of the heel in the production of hosiery.

The first set of cams 11 forms, in addition to the primary path 13, a secondary path, designated by the reference numeral 25 and indicated by a dotted line, which partially overlaps the primary path 13 and is used to actuate the needles 3 during reverse motion, indicated by the arrow 60, when the needle cylinders are actuated with an alternating motion about their own axis.

The secondary path 25, in its portions that differ with respect to the primary path 13, has, directly before and after the first feed 40 along the direction 60, a descending portion 25*a* in order to allow the descent of the needle 3 caused by the engagement of the slider 5 with the lowering cam 24 and a subsequent rising portion 25*b*.

In the forward motion (direction of arrow 30), the heel 8*b* of the actuation element 8 follows the primary path 13 until it arrives at a presser 26 that can move on command toward or away from the needle cylinders.

The actuation elements 8 of the needles 3 that are to knit at the feed 40 also in the subsequent return motion (direction of arrow 60) are kept in the second position, while the actuation elements 8 of the needles 3 that have knitted in the forward motion and must not knit at the feed 40 in the subsequent return motion are moved into the third position by the activation of the presser 26.

Likewise, in the return motion (direction 60) the heel 8*b* of the actuation element 8 follows the secondary path 25 and reaches, after the rising portion 25*b*, the holding portion 13*b* of the primary path 13.

Directly after the holding portion 13*b*, along the direction 60, in the cams 11 there is an inclined-plane portion 33, which corresponds to a presser that is always active so as to move the actuation elements 8 into the third position.

The actuation elements 8 of the needles 3 that must knit at the feed 40 also in the subsequent forward motion (direction 30) as they travel along the holding portion 13*b* in the subsequent forward motion (direction 30) are moved into the second position by virtue of the selection devices 9.

In practice, when one wishes to make a previously inactive needle 3 work at the feed 40, at the beginning of the forward motion (direction 30) or of the return motion (direction 60), by virtue of the selection devices the corresponding actuation element 8 is moved from the third position into the second position. This change of position is performed preferably just before the descending portion 13*c* of the primary path 13 in the forward motion (direction 30) and just before the descending portion 25*a* of the secondary path 25 in the return motion (direction 60).

In this manner it is possible to perform the stitch increases and decreases that are typical of heel knitting without resorting to the hammers or pickers of conventional machines.

For the sake of completeness in description, it should be noted that it is possible to provide other pressers, such as for example the pressers 28, 29, 31 and 32 similar to the pressers 17, 18, 26 and 27, in order to act on the actuation element 8 so as to make it assume the first or third position, according to the requirements, in different points of the paths followed by the heels of the actuation element 8.

In practice it has been found that the machine according to the invention fully achieves the intended aim, since it is capable of performing all the processes of conventional-type double-cylinder machines while having a much simpler cam box.

Another advantage of the machine according to the invention is that it allows to perform, at a same feed or drop, drop-stitch and tuck-stitch processes.

The machine thus conceived is susceptible of numerous modifications and variations, all of which are within the scope of the appended claims; all the details may further be replaced with other technically equivalent elements.

Although the machine according to the invention has been described only with reference to the illustrated embodiment, which relates to a machine with two feeds or drops, it may have a different number of feeds or drops.

In practice, the materials used, as well as the dimensions, may be any according to requirements and to the state of the art.

The disclosures in Italian Patent Application No. MI2000A002515 from which this application claims priority are incorporated herein by reference.

What is claimed is:

1. A double-cylinder circular stocking knitting machine, comprising lower and upper needle cylinders arranged above and coaxially with respect to said lower needle cylinder; multiple slots being formed in the curved surface of said needle cylinders and running parallel to the axis of said needle cylinders; each one of said slots accommodating a twin-hook needle, lower and upper actuation elements arranged in the lower needle cylinder, and, respectively, in the upper needle cylinder; each one of said actuation elements being provided with at least one heel adapted to protrude radially from the corresponding slot of the needle cylinder and being actuatable so as to actuate the overlying or underlying needle; a cam box being arranged around the curved surface of said needle cylinders, said cam box having a plurality of cams that form paths that can be engaged by said at least one heel; said needle cylinders being rotationally actuatable about their own axis with respect to said cam box; wherein at least said lower actuation element comprises a slider that can detachably engage the lower hook of the overlying needle and, below it, a sub-slider provided with an actuation element that has two heels, an upper one and a lower one, which are mutually spaced along an extension of, and parallel to the axis of the needle cylinders; said actuation element being able to oscillate on a plane that passes through the axis of the needle cylinders in order to assume a first position, in which said lower heel is fully contained within the corresponding slot and the upper heel is extracted from the corresponding slot, or a second position, in which said lower heel is extracted from the corresponding slot and said upper heel is fully contained within the corresponding slot, or a third position, in which said lower heel and said upper heel are both fully contained within the corresponding slot; actuation means being provided which act on said actuation element for its transfer into one of said positions; said plurality of cams of the cam box comprising a first set of cams, which define paths for said lower heel for the actuation of said sub-slider and of the overlying slider in the transfer of the corresponding needle from the lower to the upper needle cylinder and in knitting processes with an alternating motion of the cylinders about their axis, and a second set of cams, which define paths for said upper heel for the actuation of said sub-slider and of the overlying slider in the actuation of the corresponding needle in the formation of drop stitches, in the formation of tuck stitches, and in the transfer of the needle from the upper to the lower needle cylinder.

2. The machine according to claim 1, wherein said first set of cams defines a path for said lower heel in order to actuate the sub-slider and the overlying slider when the corresponding needle is arranged in the upper needle cylinder.

3. The machine according to claim 1, wherein said actuation means comprise selection devices for the passage of said actuation element into said second position or into said third position.

4. The machine according to claim 1, wherein said actuation means comprise pressers adapted to interfere with said actuation element for its transfer to said first position or to said third position.

5. The machine according to claim 4, wherein said pressers are movable on command toward said needle cylinders in order to interfere with said actuation element or away from said needle cylinders in order to avoid interfering with said actuation element.

6. The machine according to claim 4, wherein said pressers are fixed and are constituted by portions of said cams that are shaped like inclined planes.

* * * * *